United States Patent [19]

Sugisaka

[11] 4,172,218

[45] Oct. 23, 1979

[54] SWITCH STATOR AND METHOD OF MANUFACTURING SAME

[75] Inventor: Noboru Sugisaka, Furukawa, Japan

[73] Assignee: Alps Electric Co., Ltd., Japan

[21] Appl. No.: 767,756

[22] Filed: Feb. 11, 1977

[30] Foreign Application Priority Data

Feb. 20, 1976 [JP] Japan ..... 51-1776

[51] Int. Cl.[2] ..... H01H 9/00

[52] U.S. Cl. ..... 200/273; 200/247; 200/DIG. 46

[58] Field of Search ..... 200/273, 283, 272, 274, 200/293, 303, 11 DA, 11 D, 11 A, 245, 246, 247, DIG. 46; 29/630 B

[56] References Cited

U.S. PATENT DOCUMENTS

| | | | |
|---|---|---|---|
| 1,849,643 | 3/1932 | Seasongood et al. | 200/283 |
| 2,606,985 | 8/1952 | De Bell | 29/630 B |
| 3,194,931 | 7/1965 | Plusko et al. | 200/283 |
| 3,242,273 | 3/1966 | Van Der Put | 200/203 |
| 3,377,698 | 4/1968 | Eick et al. | 29/630 B |
| 3,801,728 | 4/1974 | Gallo et al. | 29/630 B |

FOREIGN PATENT DOCUMENTS

| | | | |
|---|---|---|---|
| 235157 | 8/1959 | Australia | 200/283 |

*Primary Examiner*—Richard E. Aegerter
*Assistant Examiner*—John W. Shepperd
*Attorney, Agent, or Firm*—Guy W. Shoup; Gerard F. Dunne

[57] ABSTRACT

Switch contacts are placed on a thermoplastic stator body in their desired positions and a thermoplastic holding member is pressed onto the switch contacts. The holding member is then ultrasonically or otherwise thermally welded to the stator body in such a manner that the melted portions of the holding member between the switch contacts are deformed into contact with and welded to the stator body. A groove is formed in the stator body perpendicular to the switch contacts into which excess material of the holding member flows during the welding process.

4 Claims, 10 Drawing Figures

SWITCH STATOR AND METHOD OF MANUFACTURING SAME

BACKGROUND OF THE INVENTION

The present invention relates to a switch stator and a method of manufacturing the same.

Whereas numerous methods have been proposed heretofore of attaching switch contacts to a stator body to form a complete switch stator, there is still room for improvement in the areas of ease of assembly, workability, cost reduction and manufacturing speed.

SUMMARY OF THE INVENTION

It is an object of the present invention to provide a method by which switch contacts may be attached to a stator body to form a complete switch stator which is easier and less expensive to embody than previously proposed methods.

It is another object of the present invention to provide, as a product of manufacture, a switch stator fabricated by the above method comprising a stator body and switch contacts fixed to the stator body in an extremely secure and improved manner.

In accordance with the present invention, switch contacts are placed on a thermoplastic stator body in their desired positions and a thermoplastic holding member is pressed thereon. The holding member is then thermally welded to the stator body in such a manner that the melted portions of the holding member between the switch contacts are deformed into contact with and welded to the stator body. A groove is preferably formed in the stator body perpendicular to the switch contacts into which excess material of the holding member flows during the welding process to provide a complete stator body of improved structural rigidity and appearance.

It is yet another object of the present invention to provide a generally improved stator body and method of manufacturing the same.

Other objects, together with the foregoing, are attained in the embodiments described in the following description and illustrated in the accompanying drawing.

DESCRIPTION OF THE PREFERRED EMBODIMENTS

While the switch stator of the invention is susceptible of numerous physical embodiments, depending upon the environment and requirements of use, substantial numbers of the herein shown and described embodiments have been made, tested and used, and all have performed in an eminently satisfactory manner.

Figure 1:
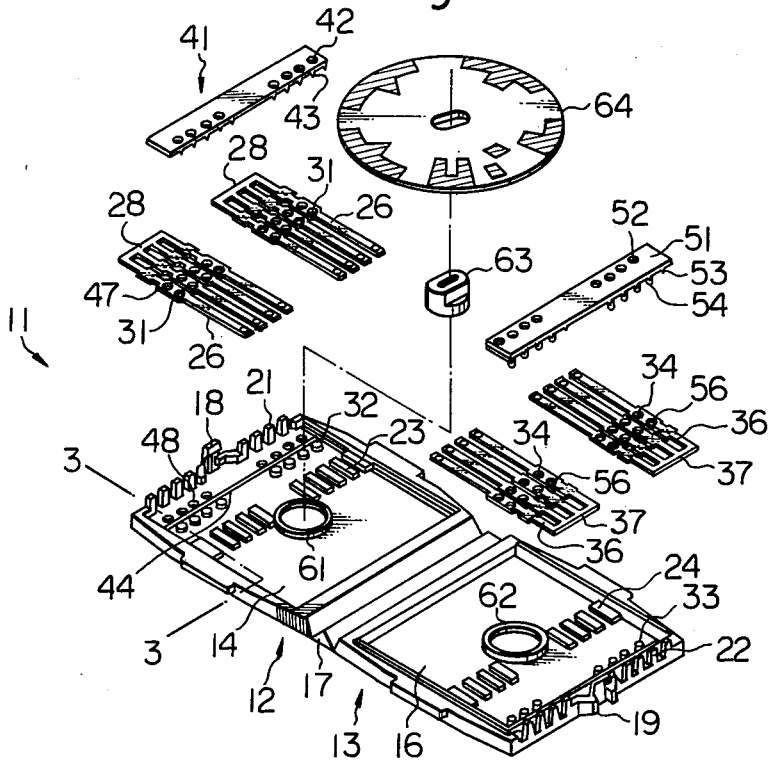
FIG. 1 is an exploded view of a first embodiment of a switch comprising two switch stators manufactured in accordance with the present invention.

Referring now to FIG. 1 of the drawing, a switch which is generally designated by the reference numeral 11 comprises two switch stators 12 and 13 each embodying the present invention. The stator 12 comprises a recessed stator body 14 which is attached to a recessed stator body 16 of the stator 13 by means of a flexible hinge 17. The stator bodies 14 and 16 and the hinge 17 are integrally molded of a thermoplastic material such as polyethylene, the hinge 17 being formed with two transverse, equilateral triangular grooves (not designated) dimensioned such that the stator bodies 14 and 16 will mate when folded toward each other. The stator body 14 is formed with a male latch member 18 adapted to interlock with a female latch member 19 formed on the stator body 16 to latch the stator bodies 14 and 16 in the folded position in the manner shown in FIG. 2.

The edge of the stator body 14 has a plurality of upstanding projections 21 which are transversely alternately spaced relative to projections 22 formed on the edge of the stator body 16, only one of each of the projections 21 and 22 being labeled for simplicity of illustration, so that the projections 21 and 22 interfit when the stator bodies 14 and 16 are folded together, thereby positively preventing any shifting of the stator bodies 14 and 16 relative to each other. The stator bodies 14 and 16 are also formed with respective elongated, longitudinally extending ridges or projections 23 and 24, only one of each being labeled, which transversely align with the projections 21 and 22 respectively.

Two groups of elongated switch contacts 26, only one contact of each group being labeled, are adapted to be placed in engagement with the stator body 14. This operation is facilitated by connector bars 28 which are integrally formed with the switch contacts 26 so that the two groups may be attached to the stator body 14 as units. The connector bars 28 are cut away after the switch contacts 26 are attached.

Each of the switch contacts 26 is configured to fit between adjacent projections 21 and 23 so as to be retained thereby against rotation. The switch contacts 26 are formed with circular holes 31 through which extend respective circular projections 32 respectively of the stator body 14 when the switch contacts 26 are assembled to the body 14. This prevents longitudinal movement of the switch contacts 26. In an essentially similar manner, the stator body 16 is formed with circular projections 33 adapted to extend through holes 34 formed in switch contacts 36 temporarily connected together in two groups by connector bars 37.

Figure 5:
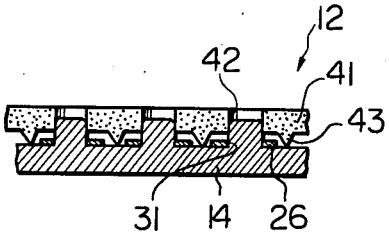
FIG. 5 is a fragmentary transverse sectional view showing the component parts of the stator assembled prior to welding.
Figure 7:
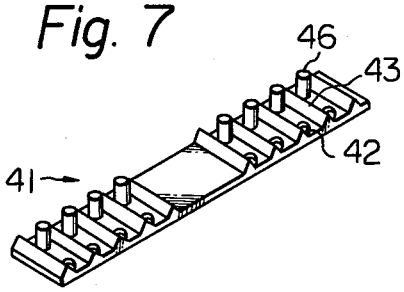
FIG. 7 is a perspective view, to an enlarged scale, of a holding member of the embodiment of FIG. 1.

As best seen in FIGS. 1 and 7, a holding member or bar 41 is formed with circular holes 42, only one hole 42 being labeled, into which extend the circular projections 32 of the stator body 14 when the switch contacts 26 are positioned on the stator body 14 with the projections 32 extending through the holes 31 thereof and the holding bar 41 is pressed onto the switch contacts 26. Alternately spaced between the holes 42 in the transverse direction are triangular ridges 43, only one ridge 43 being labeled, which contact the stator body 14 between the respective switch contacts 26. This is best viewed in transverse section in FIG. 5.

Figure 6:
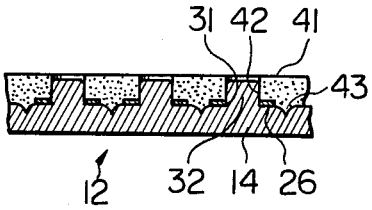
FIG. 6 is similar to FIG. 5 but shows the stator after welding.

The holding bar 41 is formed of preferably the same thermoplastic material as the stator body 14. With the components of the switch stator 12 in the position shown in FIG. 5, the holding bar 41 and adjacent portions of the stator body 14 are heated to the fusion point by ultrasonic radiation or other means. Through the combination of heat and pressure, the ridges 43 of the holding bar 41 plastically deform and are thermally welded to the conjugate portions of the stator body 14 between the switch contacts 26. During this operation, as shown in FIG. 6, the holding bar 41 moves toward the stator body 14 so that the body (not designated) of the holding bar 41 abuts against the switch contacts 26. When the welded portions solidify, the switch contacts 26 are securely attached to the stator body 14 by means of the holding bar 41 to form the completed switch stator 12.

In accordance with the present invention, a transverse groove 44 is formed in the stator body 14 into which flows excess material of the ridges 43 of the holding bar 41 during the welding process. This prevents the material from flowing external of the area between the holding bar 41 and stator body 14 and preserves the clean and attractive appearance of the switch stator 12.

Figure 3:
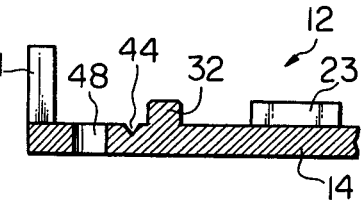
FIG. 3 is a fragmentary longitudinal sectional view taken on a line 3—3 of FIG. 1.
Figure 4:
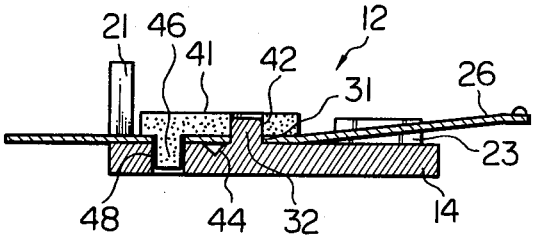
FIG. 4 is similar to FIG. 3 but shows an assembled stator.

In order to even more firmly hold the switch contacts 26 to the stator body 14, the holding bar 41 may be formed with circular projections 46 which extend through holes 47 of the switch contacts 26 and into holes 48 formed in the stator body 14. The stator body 14 is shown in longitudinal section in FIG. 3 and again in longitudinal section in FIG. 4 after attachment of the switch contacts 26 by means of the holding bar 41 for further clarity of understanding.

In a manner essentially similar to the switch stator 12, the switch stator 13 comprises a holding bar 51 formed with holes 52, ridges 53 and projections 54. The switch contacts 36 are formed with holes 56 corresponding to the holes 47. As assembled, the projections 33 extend through the holes 34 of the switch contacts 36 and into the holes 52 of the holding bar 51. The projections 54 extend through the holes 56 of the switch contacts 36 into holes (not visible in the drawing) formed in the stator body 16. The holding bar 51 is thermally welded to the stator body 16 to fix the switch contacts 36 thereto in the same manner as with the switch stator 12. A transverse groove corresponding to the groove 44 is also formed in the stator body 16, although not visible in the drawing.

The stator bodies 14 and 16 are formed with central holes 61 and 62 respectively through which rotatably extends a rotor shaft 63 when the switch stators 12 and 13 are folded together. A rotor disc 64 formed of an electrically insulative material such as plastic is provided with printed conductive patterns which are indicated by hatching but not designated by reference numerals. These patterns are provided on both sides of the rotor disc 64. As viewed in FIG. 1, the pattern on the visible side of the rotor disc 64 ohmically engages with and interconnects the contacts 36 of the switch stator 13 in a manner which depends on the angular position of the rotor disc 64. The patterns on the side of the rotor disc 64 which is not visible, selectively interconnects various switch contacts 26 of the switch stator 12 in dependence on angular position in the same manner as the patterns on the visible side. If desired, the patterns may be interconnected through the rotor disc 64 to provide a switching function involving all of the switch contacts 26 and 36, although the particular arrangement is not the subject matter of the present invention.

Figure 2:
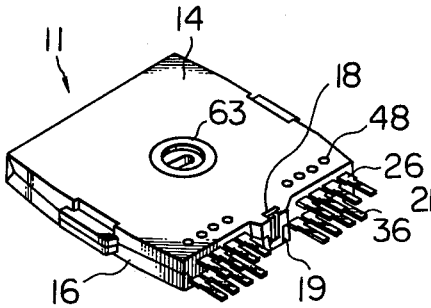
FIG. 2 is a perspective view showing the completely assembled switch.

It will be clearly understood from inspection of FIG. 2 that since the projections 21 and 22 are alternately spaced in the transverse direction, the switch contacts 26 and 36 are also transversely alternately spaced. However, the present invention is not limited to this particular configuration. For example, the stator bodies may be formed separately and joined at opposite ends by latch members. As another modification, the switch contacts may be transversely aligned. As yet another modification, the stator bodies may be formed separately and switch contacts provided at the opposite ends of body stator bodies. In each case, the contacts are attached to the stator bodies by means of holding bars which are thermally welded to the stator bodies.

Figure 8:
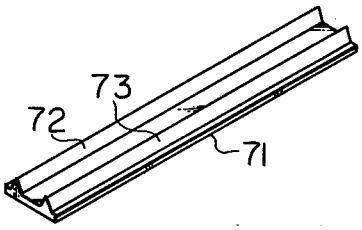
FIG. 8 is similar to FIG. 7 but shows a second embodiment of a holding member.
Figure 9:
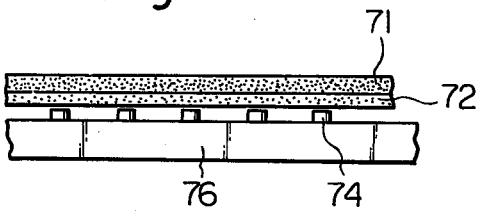
FIG. 9 is a fragmentary transverse sectional view showing a second embodiment of a switch stator comprising the holding member of FIG. 8 as assembled prior to welding.
Figure 10:
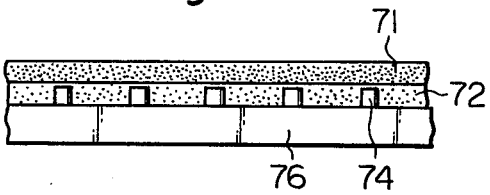
FIG. 10 is similar to FIG. 9 but shows the switch stator after welding.

FIG. 8 illustrates another and simpler embodiment of the invention as comprising a holding bar 71 formed with two longitudinal ridges 72 and 73 respectively. FIG. 9 shows how the holding bar 71 is pressed into engagement with switch contacts 74, only one switch contact 74 being labeled, placed in their desired positions on a stator body 76. The holding bar 17 is ultrasonically or otherwise thermally welded to the stator body 76 so that the ridges 72 and 73 are deformed into contact with and welded to the portions of the stator body 76 between the switch contacts 74. The body (not designated) of the holding bar 71 abuts against the switch contacts 74 during the welding process so that the switch contacts 74 are securely attached to the stator body 76 by means of the holding bar 71. Although not shown, projections and holes may be provided in a manner similar to the previous embodiment to aid in retaining the switch contacts 74 and preventing movement thereof.

In summary, it will be seen that the present invention provides a fast, secure and economical method of attaching switch contacts to a stator body which may be advantageously implemented on a commercial production basis. Many modifications not mentioned above will become possible for those skilled in the art after receiving the teachings of the present disclosure without departing from the scope thereof.

What is claimed is:

1. A switch stator comprising:

a stator body comprised of a thermoplastic material;

means formed on said stator body for spacing a plurality of contacts thereon, said spacing means including a plurality of projections extending upwardly from said stator body in spaced relation to one another;

a plurality of elongate electric contacts spaced by said spacing means, each of said contacts lying between respective ones of said projections and spaced from adjacent contacts by the thickness of the respective projection therebetween;

means on said stator body for engaging with said contacts for holding them from moving longitudinally; and a holding member lying over all of said contacts, said holding member being comprised of a thermoplastic material and having a plurality of ridges each fitting between adjacent pairs of said contacts and engaging conjugate portions of said stator body between said pairs, said ridges being welded thermally to said conjugate portions of said stator body.

2. A switch stator as in claim 1, in which one of the stator body and the holding member is formed with a plurality of projections corresponding to the switch contacts respectively and the other of the stator body and the holding member is formed with a plurality of holes conjugate to the projections, the switch contacts each being formed with a hole conjugate to the respective projection.

3. A switch stator as in claim 1, in which the stator body is formed with a plurality of retaining projections between which the switch contacts are respectively retained.

4. A switch stator as in claim 1, in which the stator body is formed with a groove parallel and adjacent to the holding member into which excess thermoplastic material of the holding member may flow when the holding member is welded to the stator body.

* * * * *